US009368912B1

(12) United States Patent
Sullivan

(10) Patent No.: US 9,368,912 B1
(45) Date of Patent: Jun. 14, 2016

(54) JUMPER CABLES WITH KEYED CONNECTORS

(71) Applicant: Keric Sullivan, Ulysses, KS (US)

(72) Inventor: Keric Sullivan, Ulysses, KS (US)

( * ) Notice: Subject to any disclaimer, the term of this patent is extended or adjusted under 35 U.S.C. 154(b) by 49 days.

(21) Appl. No.: 14/564,872

(22) Filed: Dec. 9, 2014

(51) Int. Cl.
*H01R 11/00* (2006.01)
*H01R 13/642* (2006.01)
*H01R 11/05* (2006.01)

(52) U.S. Cl.
CPC ..... *H01R 13/642* (2013.01); *H01R 11/05* (2013.01)

(58) Field of Classification Search
CPC ..... H01R 11/288
USPC ..... 439/504, 503, 677
See application file for complete search history.

(56) References Cited

U.S. PATENT DOCUMENTS 3,466,543 A * 9/1969 Lombardo ..... G01R 22/02 318/490
3,519,977 A * 7/1970 Swearingen ..... H01R 13/53 174/84 S
3,625,774 A * 12/1971 Rodgers ..... H01M 2/1083 429/121
4,637,965 A * 1/1987 Davis ..... H01R 11/287 429/1
4,885,524 A * 12/1989 Wilburn ..... H01M 2/305 307/10.1
D312,447 S 11/1990 Esslinger
5,167,529 A * 12/1992 Verge ..... H01R 11/24 429/1
5,367,243 A * 11/1994 Wells ..... H01M 2/305 320/105
5,921,809 A 7/1999 Fink
5,984,716 A * 11/1999 Starkey ..... B29C 33/0083 425/144
6,147,471 A 11/2000 Hunter
6,319,055 B1 * 11/2001 Conner, Jr. ..... H01R 11/288 439/504
6,343,949 B1 * 2/2002 Floyd ..... H01R 13/642 439/284
7,186,137 B2 * 3/2007 Rock ..... 439/101
7,300,316 B1 * 11/2007 Chen ..... H01R 13/642 439/677
7,972,142 B2 7/2011 Swiatek
8,096,825 B2 * 1/2012 Roepke ..... H01R 13/115 439/504
9,143,912 B2 * 9/2015 Leppanen ..... H04W 4/08
2004/0145340 A1 7/2004 Horenstein
2007/0123096 A1 * 5/2007 Goodwin ..... H01R 4/64 439/504
2012/0235629 A1 9/2012 Wood
2013/0034765 A1 2/2013 Kowalski
2014/0220815 A1 * 8/2014 Stecewycz ..... H01R 4/489 439/504

* cited by examiner

*Primary Examiner* — Neil Abrams
(74) *Attorney, Agent, or Firm* — Kyle A. Fletcher, Esq.

(57) ABSTRACT

The jumper cables with keyed connectors includes a set of jumper cables that include keyed connectors in-line in order to prevent a short across a vehicular electrical circuit or an explosion of a vehicular battery. The jumper cables with keyed connectors include a positive line and a negative line. Both the positive line and the negative line include male plugs that are keyed to connect with receptacles built onto the vehicular batteries. The plurality of connection units insures that only the appropriate components plug together thereby preventing inadvertent shorting across the jumper cables.

13 Claims, 7 Drawing Sheets

JUMPER CABLES WITH KEYED CONNECTORS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electrical jumper cables, more specifically, a set of jumper cables that are keyed for connection.

SUMMARY OF THE INVENTION

An embodiment of the disclosure meets the needs presented above by generally comprising a set of jumper cables that include keyed connectors in-line in order to prevent a short across a vehicular electrical circuit or an explosion of a vehicular battery. The jumper cables with keyed connectors include a positive line and a negative line. Both the positive line and the negative line include each include keyed members that enable connection with a receptacles integrated into a vehicular battery or spring-loaded clamps that connect an existing vehicular battery to the jumper cables with keyed connectors.

These together with additional objects, features and advantages of the jumper cables with keyed connectors will be readily apparent to those of ordinary skill in the art upon reading the following detailed description of presently preferred, but nonetheless illustrative, embodiments of the jumper cables with keyed connectors when taken in conjunction with the accompanying drawings.

In this respect, before explaining the current embodiments of the jumper cables with keyed connectors in detail, it is to be understood that the jumper cables with keyed connectors is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the jumper cables with keyed connectors.

It is therefore important that the claims be regarded as including such equivalent construction insofar as they do not depart from the spirit and scope of the jumper cables with keyed connectors. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
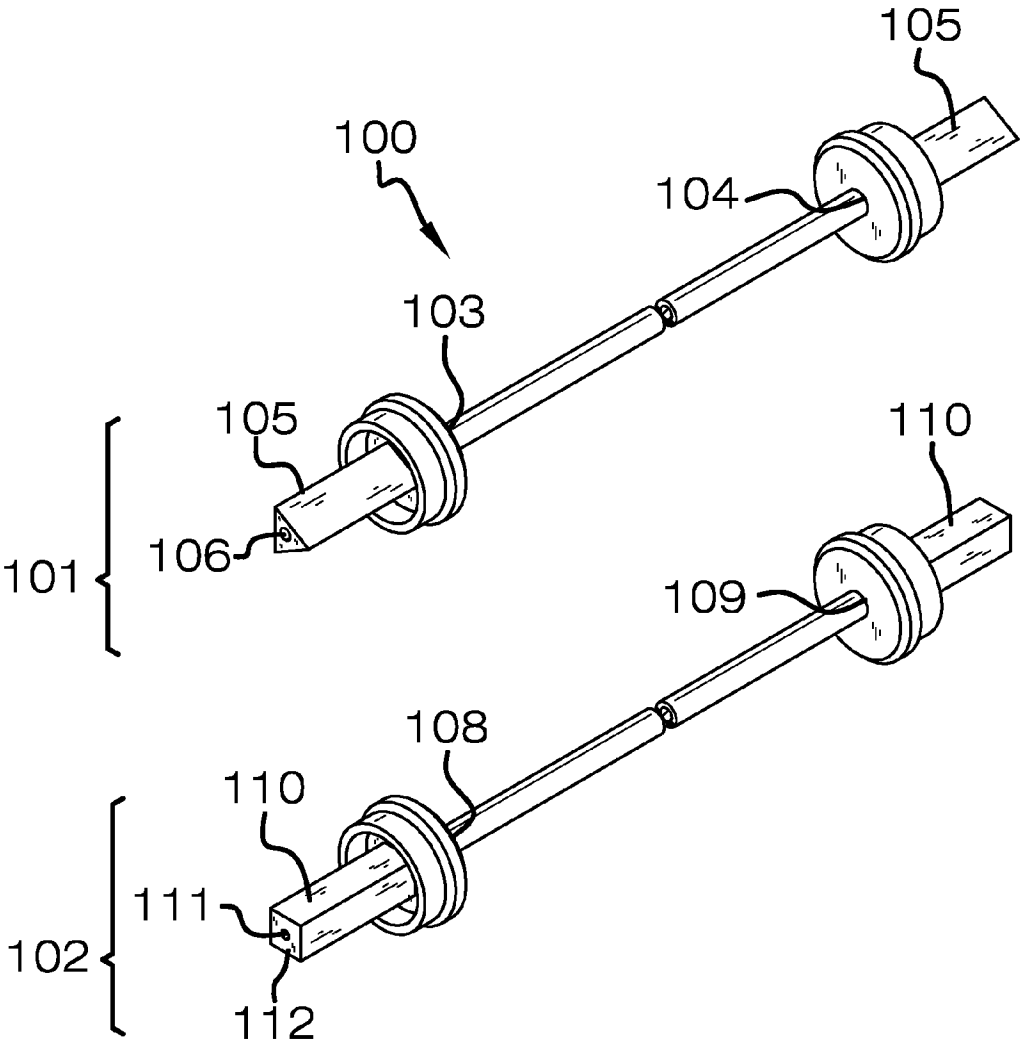
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 9, the jumper cables with keyed connectors 100 (hereinafter invention) generally comprises a negative line 101 and a positive line 102. The negative line 101 is further defined with a first negative end 103 and a second negative end 104. Both the first negative end 103 and the second negative end 104 include a first male plug 105. The first male plug 105 is triangularly-shaped, and includes a first opening 106 that extends to a first electrode 107 located therein. Moreover, the first electrode 107 is recessed with respect to the first opening 106.

The positive line 102 is further defined with a third positive end 108 and a fourth positive end 109. Both the third positive end 108 and the fourth positive end 109 include a second male plug 110 thereon. The second male plug 110 is square-shaped, and includes a second opening 111. The second opening 111 is located on an outer second surface 112 of the second male plug 110. The second opening 110 provides access to a second electrode 113 located therein. Moreover, the second electrode 113 is recessed with respect to the second opening 110. Moreover, the second electrode 113 is recessed with respect to the outer second surface 112.

The invention 100 is adapted for use with a first vehicle 400 and a second vehicle 401. Moreover, a vehicular battery 300 connects with the invention 100. The vehicular battery 300 is specially designed for use with the invention 100. The vehicular battery 300 may include a first receptacle 301 and a second receptacle 302 thereon. The first receptacle 301 is able to connect with the first male plug 105 whereas the second receptacle 302 is able to connect with the second male plug 110. As noted above, the first male plug 105 is depicted as being triangularly-shaped, whereas the second male plug 110 is depicted as square-shaped. The first receptacle 301 includes a first opening 303 that is sized with and accommodates the triangularly-shaped first male plug 105. Moreover, the second receptacle 302 includes a second opening 304 that is sized with and accommodates the square-shape of the second male plug 106.

The first male plug 105 only connects with the first receptacle 301. The second male plug 110 only connects with the second receptacle 302. Referring to FIGS. 3-6, the first receptacle 301 includes a third electrode 305 that is recessed within the first opening 303, and is able to connect with the first electrode 107. The second receptacle 302 includes a fourth electrode 306 that is recessed within the second opening 304, and is able to connect with the second electrode 113.

Figure 2:
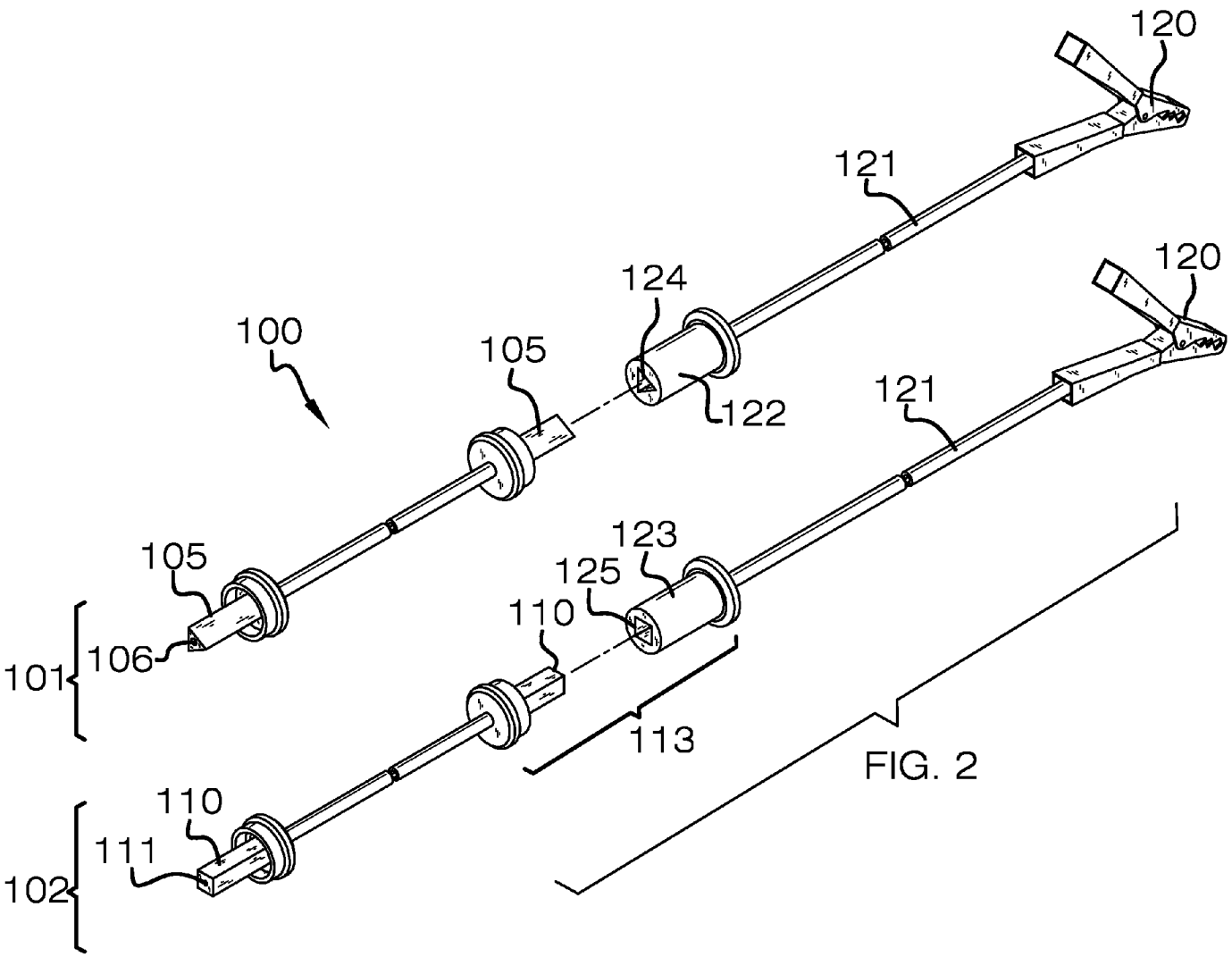
FIG. 2 is an exploded view of an alternative embodiment of the disclosure.
Figure 3:
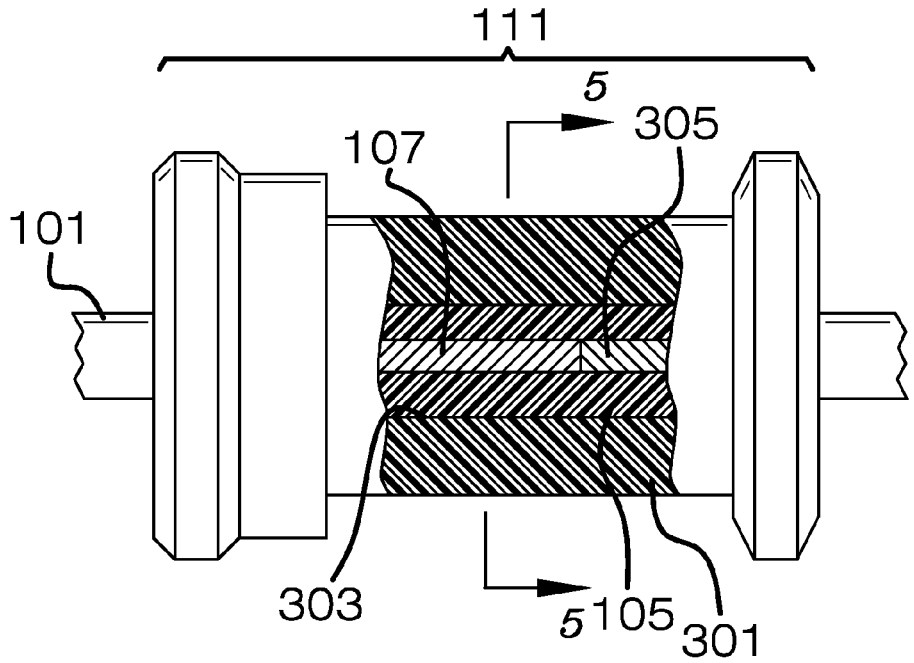
FIG. 3 is a cut-away view of an embodiment of the disclosure.
Figure 4:
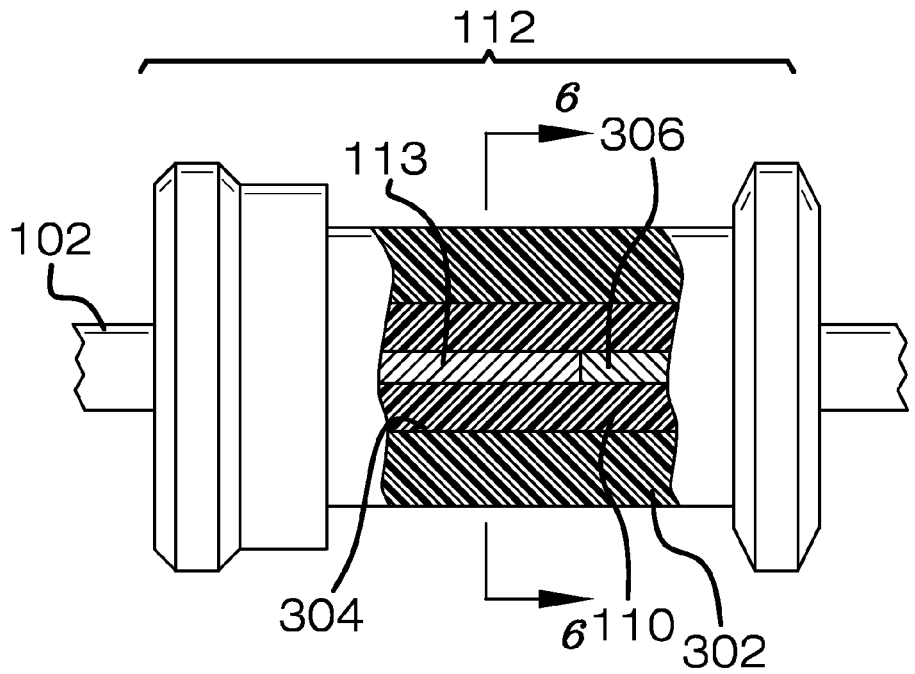
FIG. 4 is another cut-away view of an embodiment of the disclosure.
Figure 5:
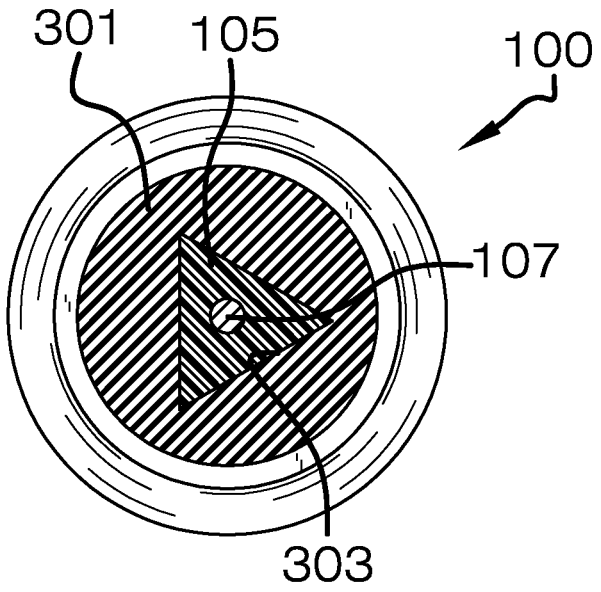
FIG. 5 is a cross-sectional view along line 5-5 in FIG. 3 of an embodiment of the disclosure.
Figure 6:
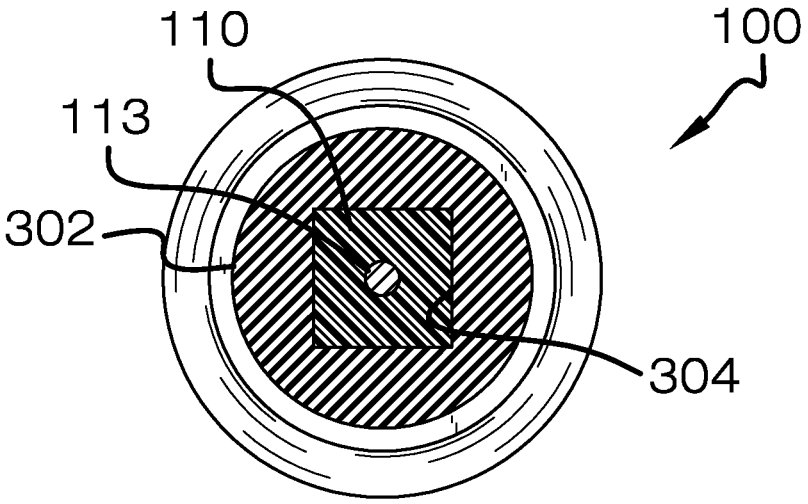
FIG. 6 is a cross-sectional view along line 6-6 in FIG. 4 of an embodiment of the disclosure.
Figure 7:
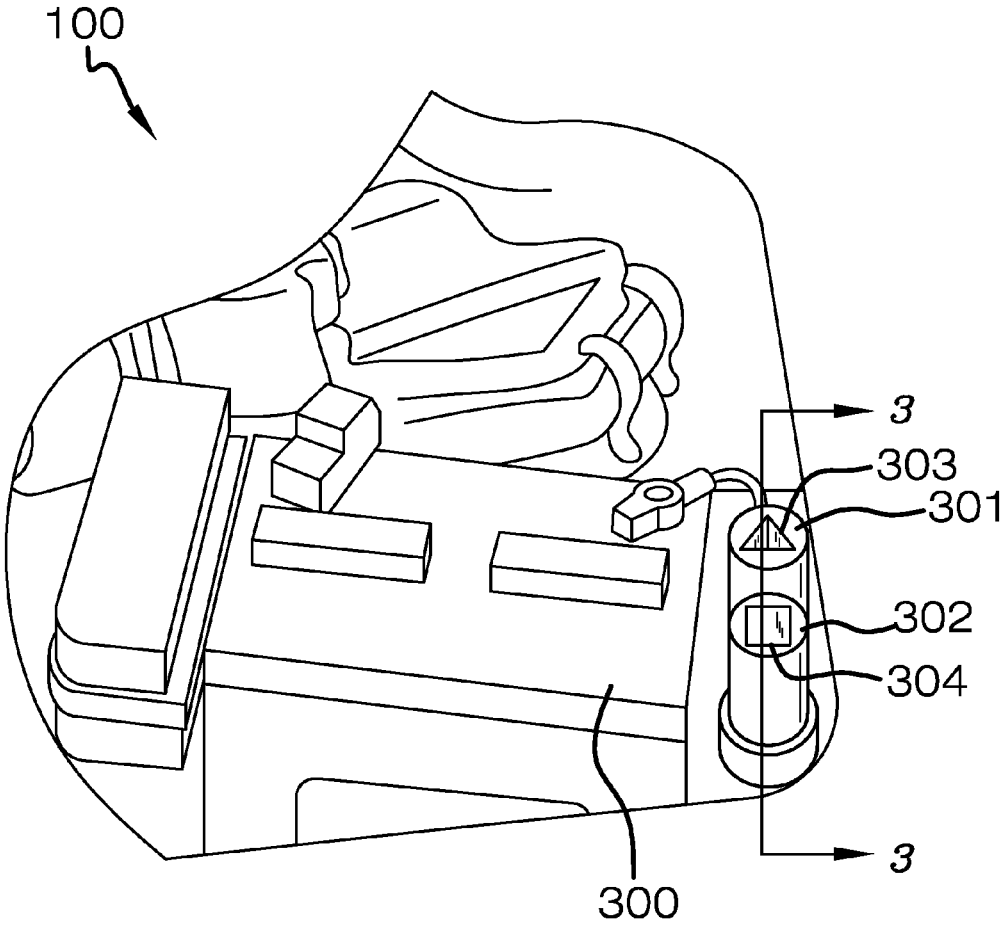
FIG. 7 is a perspective view of an embodiment in use with a vehicular battery.
Figure 8:
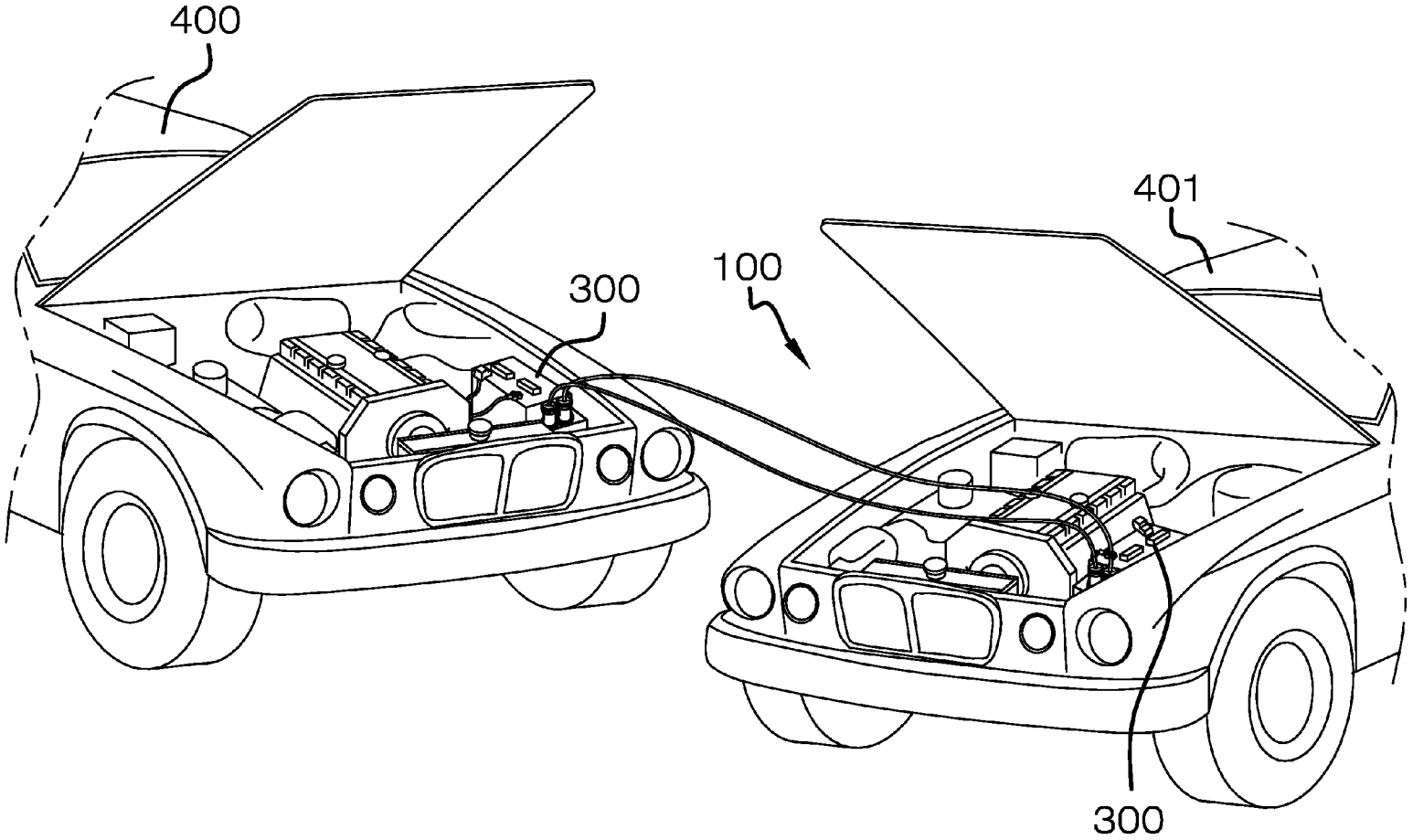
FIG. 8 is a view of an embodiment in use with two vehicles.
Figure 9:
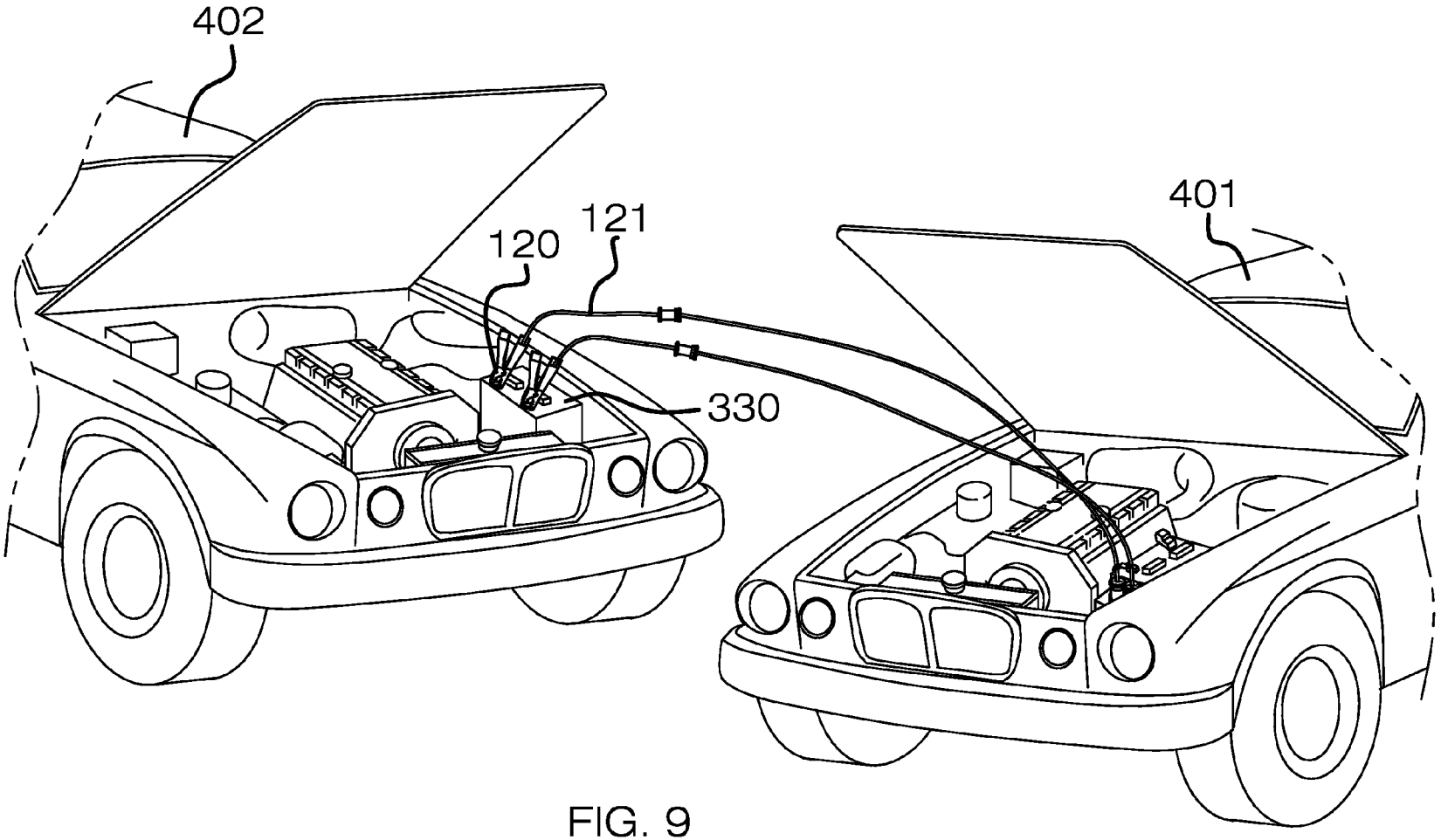
FIG. 9 is a view of an alternative embodiment in use with two vehicles.

Referring to FIGS. 2 and 9, an alternative embodiment of the invention 100 includes the use of a spring-loaded clamps 120 that are each able to connect with the negative line 101 as well as the positive line 102. The spring-loaded clamps 120 each include a clamp wire 121 that extends to a third receptacle 122 or a fourth receptacle 123. The third receptacle 122 is able to connect with the first male plug 105 of the negative line 101, whereas the fourth receptacle 123 is able to connect with the second male plug 110 of the positive line 102.

The third receptacle 122 includes a fifth opening 124 that enables the first male plug 105 to be inserted therein. The fifth opening 124 is ideally triangular in shape in order to accommodate the first male plug 105. The fifth opening 124 provides access to a fifth electrode 305 that is analogous to the third electrode 305 of the first receptacle 301.

The fourth receptacle 123 includes a sixth opening 125 that enables the second male plug 110 to be inserted therein. The sixth opening 125 is ideally square in shape in order to accommodate the second male plug 110. The sixth opening 125 provides access to a sixth electrode 306 that is analogous to the fourth electrode 306 of the second receptacle 302. The spring-loaded clamps 120 are adapted for use with an existing vehicular battery 330 of a third vehicle 402.

It shall be noted that the first male plug 105 and the first receptacle 301 of the negative line 101 may involve other geometric shapes, including but not limited to, circular, ovular, square, rectangular, pentagonal, hexagonal, octagonal, etc. The second male plug 110 and the second receptacle 302 of the positive line 102 may involve other geometric shapes, including but not limited to, circular, ovular, square, rectangular, pentagonal, hexagonal, octagonal, etc.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A jumper cable set with keyed connectors comprising:
a negative line having a first male plug on distal ends;
a positive line having a second male plug on distal ends;
said first male plug on distal ends of the negative line are able to connect with a first receptacle on vehicular batteries in order to provide keyed connection therewith;
said second male plug on distal ends of the positive line are able to connect with a second receptacle on vehicular batteries in order to provide keyed connection therewith;
wherein the negative line is further defined with a first negative end and a second negative end; wherein both the first negative end and the second negative end include the first male plug thereon;
wherein the first male plugs each includes a first opening that extends to a first electrode located therein;
wherein the first electrode is recessed with respect to the first opening.

2. The jumper cable set with keyed connectors according to claim 1 wherein the positive line is further defined with a third positive end and a fourth positive end; wherein both the third positive end and the fourth positive end include a second male plug thereon.

3. The jumper cable set with keyed connectors according to claim 2 wherein the second male plugs each includes a second opening that is located on an outer second surface of the second male plug; wherein the second opening provides access to a second electrode located therein; wherein the second electrode is recessed with respect to the second opening; wherein the second electrode is recessed with respect to the outer second surface.

4. The jumper cable set with keyed connectors according to claim 1 wherein the vehicular batteries each include the first receptacle and the second receptacle thereon; wherein the first receptacle is able to connect with the first male plug whereas the second receptacle is able to connect with the second male plug; wherein the first receptacle includes a first opening that is sized with and accommodates the first male plug; wherein the second receptacle includes a second opening that is sized with and accommodates the second male plug.

5. The jumper cable set with keyed connectors according to claim 4 wherein the first male plug only connects with the first receptacle; wherein the second male plug only connects with the second receptacle; wherein the first receptacle includes a third electrode that is recessed within the first opening, and is able to connect with the first electrode.

6. The jumper cable set with keyed connectors according to claim 5 wherein the second receptacle includes a fourth electrode that is recessed within the second opening, and is able to connect with the second electrode.

7. The jumper cable set with keyed connectors according to claim 6 wherein spring-loaded clamps are each able to connect with the negative line as well as the positive line in order to adaptively connect with an existing vehicular battery.

8. The jumper cable set with keyed connectors according to claim 7 wherein the spring-loaded clamps each include a clamp wire that extends to a third receptacle or a fourth receptacle.

9. The jumper cable set with keyed connectors according to claim 8 wherein the third receptacle connects with the first male plug of the negative line, whereas the fourth receptacle connects with the second male plug of the positive line.

10. The jumper cable set with keyed connectors according to claim 9 wherein the third receptacle includes a fifth opening that enables the first male plug to be inserted therein.

11. The jumper cable set with keyed connectors according to claim 10 wherein the fifth opening provides access to a fifth electrode.

12. The jumper cable set with keyed connectors according to claim 11 wherein the fourth receptacle includes a sixth opening that enables the second male plug to be inserted therein.

13. The jumper cable set with keyed connectors according to claim 12 wherein the sixth opening provides access to a sixth electrode.

* * * * *